United States Patent [19]

Busch et al.

[11] Patent Number: 4,974,515

[45] Date of Patent: Dec. 4, 1990

[54] WARHEAD

[75] Inventors: Jurgen-Michael Busch, Wendelstein; Georg Stammel, Lauf; Bernd Gundel, Neuhaus, all of Fed. Rep. of Germany

[73] Assignee: Diehl GmbH & Co., Nuremberg, Fed. Rep. of Germany

[21] Appl. No.: 379,490

[22] Filed: Jul. 13, 1989

[30] Foreign Application Priority Data

Jul. 14, 1988 [DE] Fed. Rep. of Germany ..... 3823823

[51] Int. Cl.[5] ..... F42B 12/58; F42B 12/10

[52] U.S. Cl. ..... 102/476; 102/489; 102/501

[58] Field of Search ..... 102/475, 476, 265, 266, 102/305, 340, 342, 351, 357, 393, 306, 310, 491–496, 489

[56] References Cited

U.S. PATENT DOCUMENTS

| | | | |
|---|---|---|---|
| 2,725,011 | 11/1955 | Sunderman . | |
| 3,145,656 | 8/1964 | Cook et al. . | |
| 3,633,510 | 1/1972 | Bernardin . | |
| 3,769,911 | 11/1973 | Folkins . | |
| 3,913,488 | 10/1975 | Duntz et al. . | |
| 3,968,748 | 7/1976 | Burford et al. . | |
| 4,175,491 | 11/1979 | Thomanek . | |
| 4,458,596 | 7/1984 | Armstrong | 102/393 |
| 4,488,488 | 12/1984 | Looger et al. . | |
| 4,498,393 | 2/1985 | Fischer et al. | 102/489 |
| 4,690,062 | 9/1987 | Bugiel | 102/476 |
| 4,714,020 | 12/1987 | Hertsgaard | 102/489 |
| 4,853,059 | 12/1974 | Mae | 102/492 |

FOREIGN PATENT DOCUMENTS

| | | | |
|---|---|---|---|
| 2311287 | 12/1974 | Fed. Rep. of Germany . | |
| 3326877 | 2/1985 | Fed. Rep. of Germany | 102/489 |
| 3540219 | 5/1987 | Fed. Rep. of Germany | 102/489 |
| 2807309 | 7/1987 | Fed. Rep. of Germany . | |
| 3337115 | 11/1988 | Fed. Rep. of Germany . | |
| 2287027 | 4/1976 | France | 102/476 |
| 1092563 | 4/1985 | France | 102/476 |
| 2193796 | 2/1988 | United Kingdom . | |

OTHER PUBLICATIONS

European Search Report.

*Primary Examiner*—Harold J. Tudor
*Attorney, Agent, or Firm*—Scully, Scott, Murphy & Presser

[57] ABSTRACT

A warhead which is deliverable through the intermediary of a carrier, and which incorporates aerodynamic guiding and braking media and forwardly oriented striking pins for initiating a detonating information for an explosive which is contained or dammed by a hollow-cylindrical wall structure with shallow-concavely curved coverings. The coverings are designed for a fragmentation angle which increases upwardly from below along their projectile directions of flight or trajectories, and in which a firing and pin is imparted a responding threshold which leads to the initiation of the detonating information only under a relatively hard impact.

8 Claims, 5 Drawing Sheets

-14-
11
12
13
15
16
17
18
18'
19
20
29

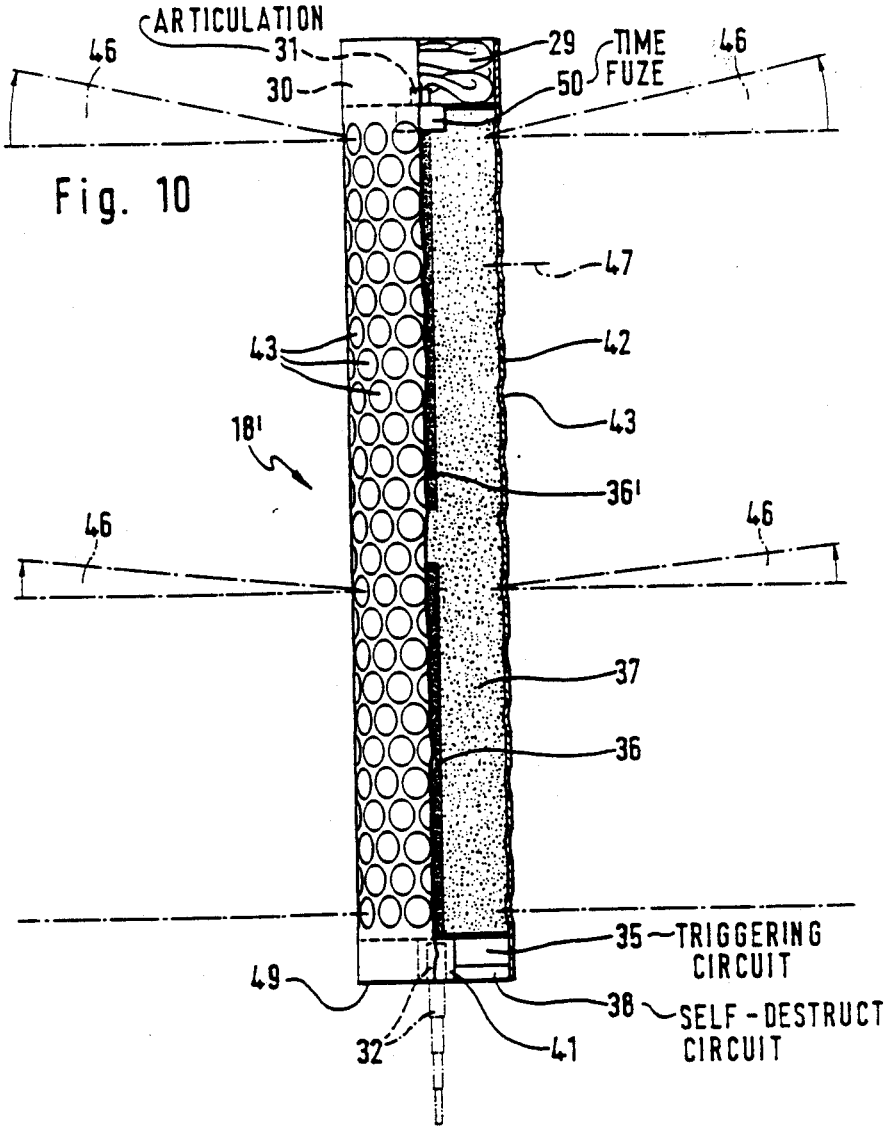
Fig. 10
Fig. 11
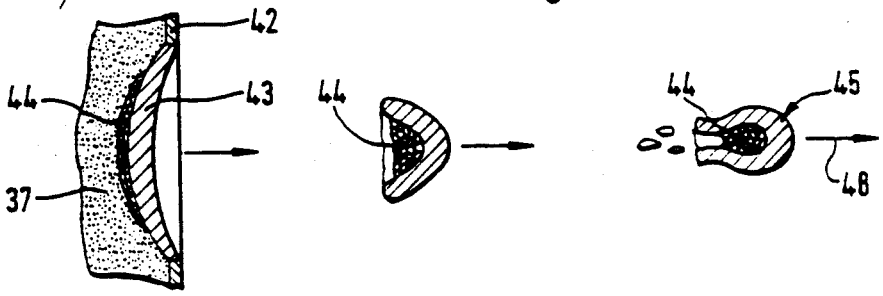

WARHEAD

BACKGROUND OF THE INVENTION

1. Field of the Invention

The present invention relates to a warhead which is deliverable through the intermediary of a carrier, and which incorporates aerodynamic guiding and braking media and forwardly oriented striking pins for initiating a detonating information for an explosive which is contained or dammed by a hollow-cylindrical wall structure with shallow-concavely curved coverings.

2. Discussion of the Prior Art

Warheads of that type are known in the configuration of carrier projectiles or missiles for bomblets with jet-forming hollow charge inserts; for instance, as disclosed in U.S. Pat. 4,488,488; or as the artillery rocket system MLRS-1 for the delivery of bomblets over a previously reconnoitered target area. The effectiveness of each individual bomblet upon impact against a semi-hard to hard armored target object is, in essence, relatively slight; however, at a dense covering of a target area with bomblets, there may be expected a multiple-hit effect in a target object with a correspondingly enhanced cumulative effect in the target.

In a warhead concept of that type it is especially disadvantageous that the intended multiple-effect necessitates an extremely dense distribution of the bomblets over the target object, in which the target objects which are actually to be attacked are only present at some distances from each other. The dense delivery can also lead to erroneous or unintended detonations which are caused by collisions between bomblets during their descent into the target area. However, above all, the effectiveness of such types of bomblet warheads possessing jet-forming hollow charges reduces itself quite drastically when they are deployed against target objects which are in a protected condition, such as; for instance, against armored vehicles and roadways under a light natural or artificial covering such as protective roof structures, as shown in German Laid-Open Patent Appln. No. 33 37 115, or under trees.

Hereby, even the light lattice work of a camouflage installation or the branches of a tree, in response to the impact of a bomblet possessing jet-forming hollow charge-inserts, will lead to the triggering thereof and, as a consequence, to a dissipation of their effectiveness from the standpoint of the ammunition technology at some distance above the target object which is actually of interest.

On the other hand, one has to proceed from the assumption that enemy formations prepare themselves in departure and staging areas for their employment in, which combat areas, through the intermediary of forests, functional structures simulating towns or locales and camouflage measures, are optimally protected against reconnaissance surveillances, and thereby also against the action of usual bomblet ammunition. Also material ordinarily employed in large quantities, the utilization of which are important (such, as ammunition and fuel), and in the case of their deployment, cannot be carried along under heavy protective structures, but they are bound to storage depots which are underfield or combat conditions, for which there is utilized to the greatest possible extent, the available natural or the rapidly assemblable artificial lightweight protective condition.

SUMMARY OF THE INVENTION

Accordingly, in recognition of these conditions, it is an object of the present invention to provide a warhead of the type under consideration herein, which is deployable through the intermediary of a carrier, especially such as an already militarily introduced or proven artillery rocket, which promises a greater degree of effectiveness during employment thereof against enemy target objects which are in a lightly protected condition pursuant to the above-mentioned type.

The foregoing object is inventively achieved in that the warhead of the type considered herein is equipped with wall or surface coverings which are designed for a fragmentation cone or angle of spread directions of flight or trajectories, of the projectiles formed by the wall coverings which increases from the leading end of the descending warhead towards the trailing end thereof and in which a firing pin is imparted a responding threshold which leads to the initiation of the detonating information only under conditions of a relatively hard impact.

Already known from the disclosure of U.S. Pat. No. 4,175,491 is a warhead possessing a radial projectile-forming mantle surface covering, with aerodynamic braking means and with a telescopable trigger pin; however, in that instance, through simultaneous triggering of a plurality of individual P-charges (projectile-forming charges) with corresponding constructive adjustment relative to the vertical, there is generated along the central longitudinal axis of the warhead only a fanning or spreading out of P-charge fragments which is oriented forwardly relative to the horizontal which results in quite considerable restrictions on the basis of construction and effectiveness with regard to the design length of the warhead and the height of the target objects which are of interest. The enemy target objects which stand in the protected position can, in effect, only be attacked by this presently known warhead when it is brought to detonation upon striking against the protection above the target object; with a correspondingly lower effectiveness in the target because of the low inclination or angle of incidence of the P-fragments relative to the horizontal, inasmuch as the target objects are first struck at a greater distance in essence, first through applicable natural and artificial protective arrangements which are possibly located therebetween) and only at a shallow or narrow angle from above.

From U.S. Pat. No. 3,968,748 it is known that for a bomblet of the above-mentioned type, in essence, possessing a jet-forming hollow charge-insert, through a telescopable striker or trigger pin there can be evaluated the thickness of the object against which there is carried out the impact; with the task that, at a hard impact (especially against a heavily-armored target object), the detonation is immediately initiated and in contrast therewith, upon a soft impact (for example, such as against a soft background) the bomblet is once again thrown back, and is detonated at only a certain distance above the ground, in order to at least still generate a radially directed fragmentation effect. A triggering mechanism of that kind is not employable with any promise of success against enemy target objects in a protected condition, inasmuch as the soft impact against the protection (for instance, the branches of trees or the covering of a shelter) will not allow for the expectation of an adequate fragmentation effect in the target object which is present below the protection, subsequent to the springing back of the bomblet. The inventive object and structure is, in contrast with the foregoing, designed in a manner in that the warhead, which can be constructed as a single piece-integral warhead or divided into submunitions, will not yet be detonated upon striking against the protective structure. More likely, the light protection is initially broken through and only the essentially harder direct impact against the armored target object; or for example, the highly-compacted or even concrete-covered roadways, will lead to the triggering of an upwardly fanned out fragment cone, so as to be able to attack lightly to semi-hard armored objects located in the surroundings over their large side surfaces with the highly-energetic P-charge fragments.

In contrast with the conditions which are encounterd in the utilization of jet-forming bomblets, it is consequently no longer necessary to provide the densest possible covering of the target area with bomblets in order to be able to achieve more hits in a single target object from above. Consequently, instead of bomblet warheads there can also be advantageously employed single piece-integral warheads of greater mass and with larger numbers of P-charge coverings; whereas on the other hand, the smaller submunitions which are produced from the warhead can be more widely dispersed. As a result thereof, it is expedient to produce a warhead delivery transversely of the direction of flight of the deploying carrier in different directions, for which purpose there can be deployed integral warheads or bomblet distributing units coaxially within slender carriers (such as the MLRS rocket) or; however, in an axially-parallel packing within carriers possessing larger diameters (such as the Atacms rockets).

The degree of effectiveness in the target can be increased through a secondary incendiary effect in that the P-inserts are lined along their rear surfaces with incendiary compositions which penetrate into the center of the projectile during the explosive-deformation of the insert, and can thus be delivered with dependability into the target object. Thereby, the secondary incendiary effect is, in every instance, more extensive than with the utilization of a combustible auxiliary composition in the center of a jet-forming hollow charge-insert; for example, such as is known from the disclosure of German Laid-Open Patent Appln. No. 23 11 287.

In order to avoid that the warheads with their aerodynamic orienting and braking media will remain suspended or hung up in the protective arrangement, there is expediently provided a sufficiently lengthy connecting cable or tethering line between the braking medium and the warhead, so that the last-mentioned will already lead to an impact in the target area when the braking medium; for instance, the parachute, still floats above the protective arrangement, for example, the crown of a tree. However, instead thereof, or in addition thereto, there can also be contemplated a reversal in the action of the triggering, such that the fanning out or conical dispersements of P-charge fragments is oriented downwardly from above when, after the passage of a certain time interval, there has not been ascertained any impact in the target area; and apparently the warhead has been caught; for example, in the branches of a tree. The resultingly initiated self-destruction then leads to at least some effect of the warhead in the surroundings about the target objects.

BRIEF DESCRIPTION OF THE DRAWINGS

Reference may now be had to the alternatives and modifications, as well as further features and advantages of the invention, as set forth in the following detailed description of preferred embodiments and examples in the utilization of the inventive warhead, taken in conjunction with the accompanying drawings; in which:

FIG. 10 illustrates, in a detailed, partly sectioned representation, a full caliber-sized warhead pursuant to FIG. 4;

FIG. 11 illustrates the deformation and transport sequence of the P-charges having rear linings of incendiary compositions located on the warheads pursuant to FIG. 3 or FIG. 4.

DETAILED DESCRIPTION

Figures 1, 2, 3, 4:
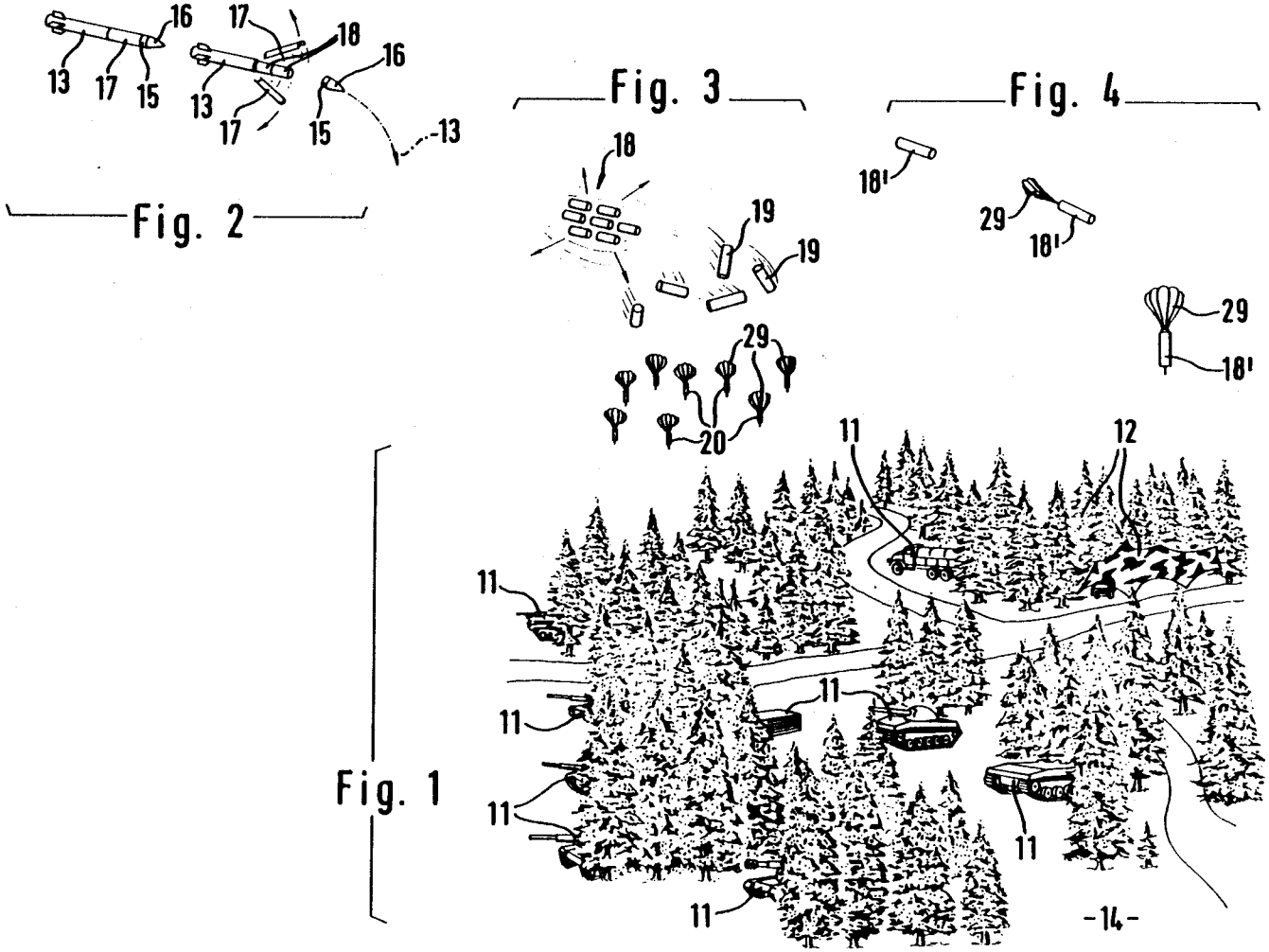
FIG. 1 illustrates an exemplary scenario for the target objects which are to be attacked under a natural and artificial protected condition.
FIG. 2 illustrates the rocket delivery of a warhead for the attacking of enemy target objects in the protected condition.
FIG. 3 illustrates the delivery of P-charge submunition from a multiple-warhead.
FIG. 4 illustrates the delivery of a full caliber-sized warhead.

The scenario pursuant to FIG. 1 illustrates target objects 11 which are to be attacked, such as armored vehicles, ammunition and fuel supply dumps or heavy trucks, which are stationed secured so as to be at least partially screened against direct sight and attacking effects from above below light, natural (for instance, trees) or artificial (for instance, camouflaged protective structures) protections 12 in combat or staging position. The indirect attacking of such target objects 11 which are located in this manner in a protected condition by means of currently introduced bomblet ammunition with downwardly-forwardly oriented jet-forming explosives inserts is only slightly effective, inasmuch as these bomblets, because of their functional requirements, are already detonated upon striking against the protective position or structure. The jet-forming insert of the respective bomblet which is sized for penetration into heavy armoring, leads in the protective structure to only slight destruction, and no significant or mentionable effect in the target object itself which is located therebeneath.

As a consequence of the foregoing, pursuant to the present invention there is carried out the attacking of such types of target objects 11 which are in a protected position through the intermediary of warheads 18 which are particularly designed for this purpose, and which are delivered over a previously reconnoitered target area 14 in the usual manner by means of a carrier 13, such as a ballistic cargo projectile; preferably, however, in the form of a rocket (FIG. 2). At that location, through a time-activated or remote-controlled fuze 15, there are pyrotechnically blown off the nose cone 16 and the parts of the casing 17. The warhead 18 is resultingly freed from the carrier 13, the latter of which will then drop down steeply because of its ballistically inexpedient geometry and conditions in its center of gravity. With respect to the warhead 18 (FIG. 2), this can pertain to one or more elongated-cylindrical structures (FIG. 4) subsequently designated as unitary or single piece warheads 18', or can pertain to one or more stacks of short-cylindrical active bodies (submunitions 20; FIG. 3) which are spread out from sleeve-like distributing units 19. Thus, in the last-mentioned case, this relates to a delivery in conformance with that of the MLRS 2 weapon system with an ejection device for AT-2 ground mines employed against heavily-armored target objects.

Figure 5:
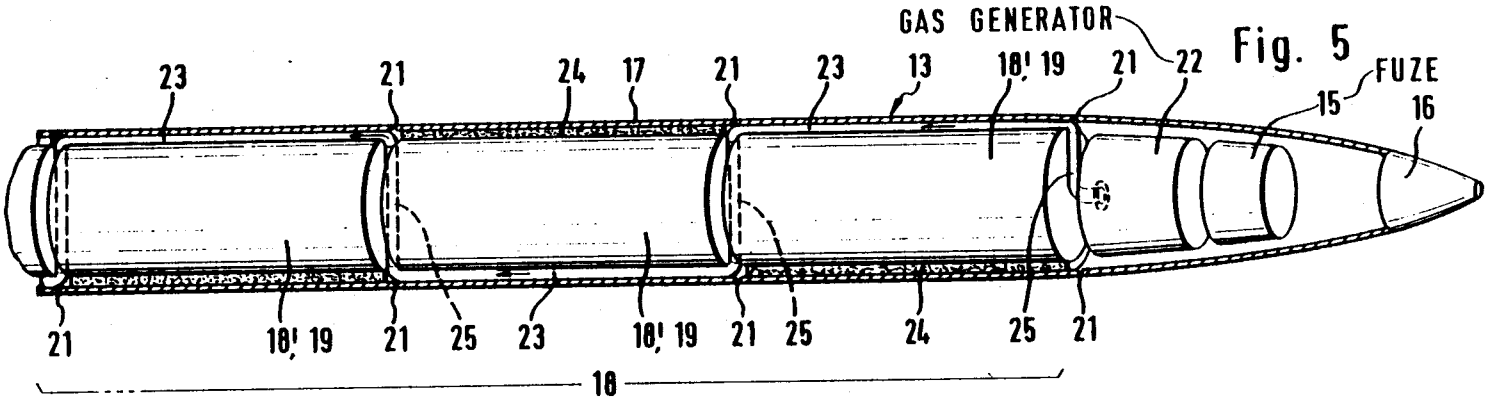
FIG. 5 illustrates the installation of a plurality of coaxially arranged, full caliber-sized warheads pursuant to FIG. 4, such as a plurality of approximately equal caliber-sized distributing units having articles of submunition pursuant to FIG. 3, employing a slender artillery-fired rocket as a delivery system.

Inasmuch as the effect of the above warheads 18 is no longer predicated on the multiple-hit concepts through hollow charge-bomblets, it is possible to attain an essentially broader covering over the target surface. In order to be able to obtain, through the use of a slender carrier 13, the widest possible spreading region over a target area, it is expedient that, pursuant to the illustrated representation of FIG. 5, a plurality of almost full caliber-sized single piece warheads 18' and/or distributing units 19 be arranged coaxially behind each other or in sequence within the casing 17, the latter of which is rupturable along breaking locations 21, and to release the former not forwardly therefrom (FIG. 2), but rather to eject these in different radial directions. For this purpose, in the exemplary instance, a gas generator 22 is activated by the fuze 15, which radially inflates a hose 23, which is conducted along the inner wall of the casing 17 meanderingly changing along different sides of the almost caliber filling warheads 18' or in essence distribution units 19, which for the remainder are form-fittingly fixed in position by profiled cups 24 of plastic material. Serving as diametrical connections between the hoses 23 which extend along the different sides, as well as a blow tube in connection with the gas generator 22, are stiff supply tubes 25 so as not to obstruct the radial dispersion procedure through axially spreading loads.

Figure 6:
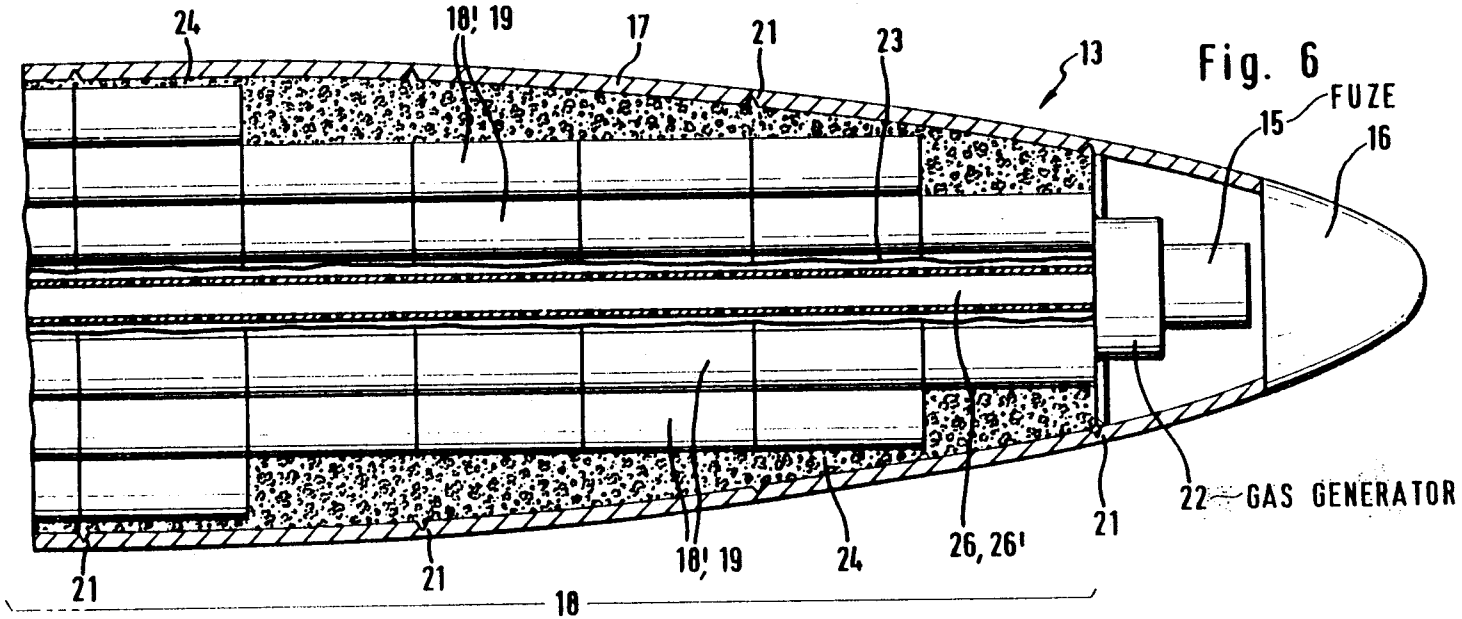
FIG. 6 illustrates the installation of subcaliber-sized warheads or distributing units arranged in large caliber-sized tactical combat-field rockets employed as a delivery system.

For larger calibered carriers 13 (FIG. 6) in the interest of obtaining a widest possible area of spread for the single piece or multi-component warheads 18, it is more expedient to dimension these in subcaliber-size and to arrange them as a plurality of axially-parallel stacks eccentrically adjacent each other within the rupturable casing 17 (FIG. 6). Thereby, warheads 18 can also be arranged in the forwardly conically narrowing region of the carrier 18. Due to reasons based on manufacturing technology and logistics, it is expedient that only cylindrical single piece warheads 18 an distributing units 19 of the same diameter need be prepared for this equipping. The foamed plastic material profiled cups 24 are consequently so configured and divided such that they are positioned outside of the carrier 13 about a central gas passageway 26, and then the individual cup portions are adhesively joined to each other, and thus completely armed with ammunition, inserted from the rear into the narrowing casing 17, and then able to be connected to the gas generator 22. The hose 23 which is radially inflatable from the gas generator 22 for the radial ejection of the warheads 18, and when necessary also for the radial breaking open of the casing 17 along its breaking locations 21, extends in this exemplary instance (FIG. 6) about a central perforated gas passageway 26'.

Figure 8:
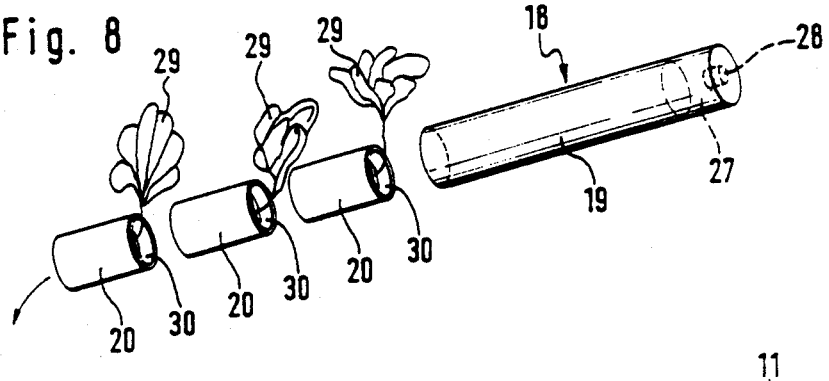
FIG. 8 illustrates the ejection sequence for submunitions pursuant to FIG. 3 shown in a detailed perspective representation.

In the event that the warheads 18 are constructed as distributing units 19 for submunitions 20, then they possess a coaxially-acting ejecting arrangement 27 (FIG. 8), which is designed as the above-mentioned gas generator 22, and with this; however, through a delay charge 28 which is triggered, for instance, as a result of the ejection from the carrier 13, in order to axially slide the submunitions 20 out of the tail end.

The submunitions 20 (FIG. 3), or respectively the integral warheads 18' (FIG. 4) are equipped with a parachute or a balloon forming aerodynamic braking and orienting means 29 for the effectuated orientation which is vertically directed towards the target area 14, which upon release from the casing 17, or respectively from the distributing unit 19, are either drawn out by the effects of the onflowing surrounding medium from a packing space 30 and tensioned to open or to inflate. The hereby practically suddenlike articulation 31 which responds to pull serves as a mechanical activating installation for the release of an eccentrically (FIG. 7) or concentrically (FIG. 10) arranged, outwardly swingable and/or telescopically extendable trigger pin 32 (compare with British Patent No. 2,193,796), whose outward movement can be effectuated generally through the release of a spring force-accumulator or through the initiation of a pyrotechnic power element (not shown), and which latches in the extended position thereof. At a hard axial force acting against the extended trigger pin 32, especially as a result of an impact against the armoring of a target object 14 which is to be attacked, a sensor 33 is mechanically activated (such as a mechanical switching element), in order to deliver a triggering information 34 (FIG. 7) to a safe-and-arm and triggering circuit 35, from which there is triggered the transmitting charge 36 for the detonation of the explosive 37. Moreover, this initiation can be carried out through a self-destruct circuit 38, which is similarly released by means an effective connection 39 from the articulation 31, and which leads to the detonation of the explosive 37 when, commencing from the unfolding of the aerodynamic orienting and braking medium 29, the trigger pin 32 does not detect a hard target impact within a predetermined time interval.

Contrastingly, a soft or non-hard target impact does not lead to the output of the triggering information 34. This will ensure that during the penetration through the artificial or natural protection 12, the explosive 37 will not detonate, inasmuch as the effective charges of the warhead 18' or respectively its submunition 20 would detonate too far above the target objects 11 which are to be attacked, and would not cause any adequate effect therein (as discussed hereinbelow). The discrimination between the penetration of the protection 12 and the actual triggering of a detonating information 34 is effected by means of a response threshold 40 for the functioning of the trigger pin 32 or, respectively, the sensor 33 which is influenced by the latter. This response threshold 40 can be a resilient power-transmitting or form-fitted arresting device which will open only upon an adequate longitudinal stress being exerted on the trigger pin 32, and which releases the latter for influencing the sensor 33, but in the presence of a lower longitudinal stress acting against the trigger pin 32 will resiliently restrain the latter and reconvey it into its initial starting position; such as is generally known from the fuze technology pertaining to double-bolt delay sensors for the arming sequence.

Figure 7:
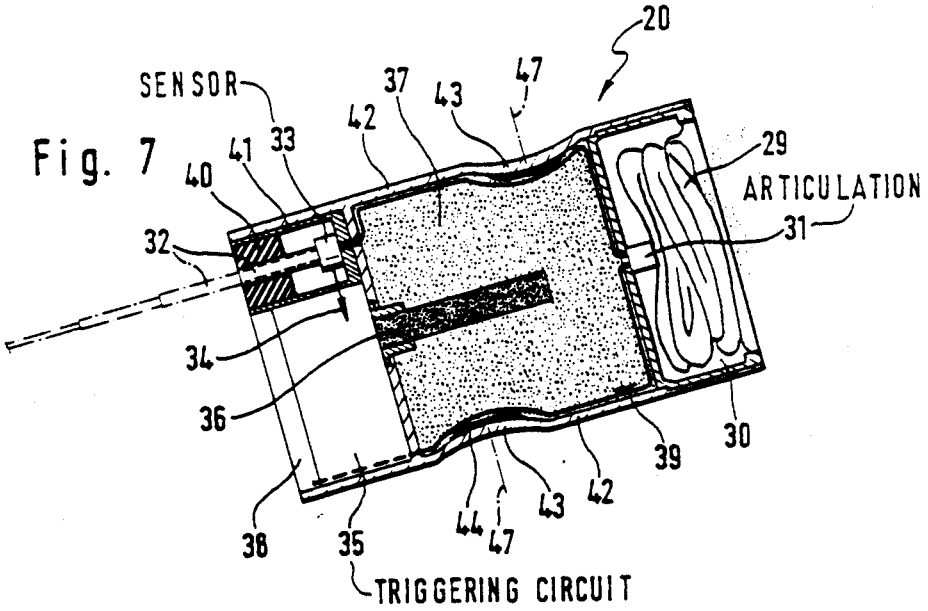
FIG. 7 illustrates an article of P-charge submunition pursuant to FIG. 3 shown in a detailed longitudinal sectional representation.

As another constructive solution for such a response threshold 40, in FIG. 7 there is indicated a thick rubber sleeve or bushing which is radially vulcanized intermediate the trigger pin 32 and its telescoping housing 41, and only under a sufficiently strong and lengthily maintained axial stressing will allow for the tearing out of the trigger pin 32 for effecting the actuation of the sensor 33. The same effect can be achieved through the installation of a cylindrical spring or a hydraulical damping element.

When the trigger pin 32 which is latched in its extended position, possibly after penetrating the protection 12 which in the form of thin branches or covering boards, strikes against the contrastingly more solid bottom ground in the target area 14 (FIG. 9), the explosive 37 is then detonated as described, which explosive is dammed or contained within a hollow-cylindrical wall structure 42. The wall structure possesses a number of concave recesses or depressions which are axially and peripherally offset relative to each other, and which are designed as spherically cap-shaped hollow charge-coverings 43, and at their convex inner mantle surfaces are lined with an incendiary composition 44 (FIG. 11). The deformation sequence which is caused by the detonated explosive 37 (FIG. 11) towards the projectile 45 which is accelerated radially relative to the wall structure 42, leads to the incendiary composition 44 being folded into the interior of the projectile 45 and, as a result thereof, soon penetrating into the target will be introduced into the interior of the target object 11, as a consequence of which the penetrating action is imparted a supplement through secondary incendiary effects; for example, in order to detonate munition supply dumps or fuel supply containers.

Inasmuch as the probability is greater that the triggering impact of the trigger pin 32 will not take place on a target object 11 in the target area 14, but rather in proximity to the target object 11 (FIG. 9), the direction of the movement of the projectiles 45 which is formed from the wall structure 42 is expediently imparted a fanning out of fragments at an angle a which increases in size from the forward or leading projectiles towards the rearward projectiles 45 of the wall structure in the direction of flight thereof, so that there is encompassed a certain range over the height of the target object 11 (FIG. 9) by the fan or conical spread of fragments 46.

This fan or conical spread (of fragments 46 can be generated in that the transverse axes 47 over the height of the wall structure 42 are imparted corresponding, increasing angles of incidence relative to the radials. However, from the standpoint of manufacturing technology it is simpler that all covering axes 47 are oriented in parallel with each other, transverse to the axis of the wall structure 42, and through a relatively slowly burning concentric transmitting charge 36 of larger axial length (FIG. 10), to thereby produce such kinds of superpositions in the detonation waves that the launching directions 48 of the projectile (FIG. 11) will increasingly lift up relative to the horizontal as the ignition propagates further away from the forward end surface 49.

Figure 9:
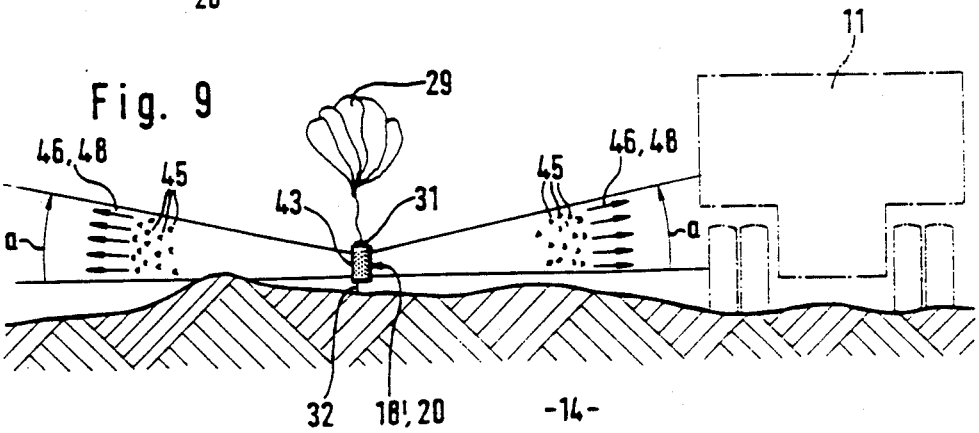
FIG. 9 illustrates the range of effectiveness for the submunition pursuant to FIGS. 3 and 4.
Figure 12:
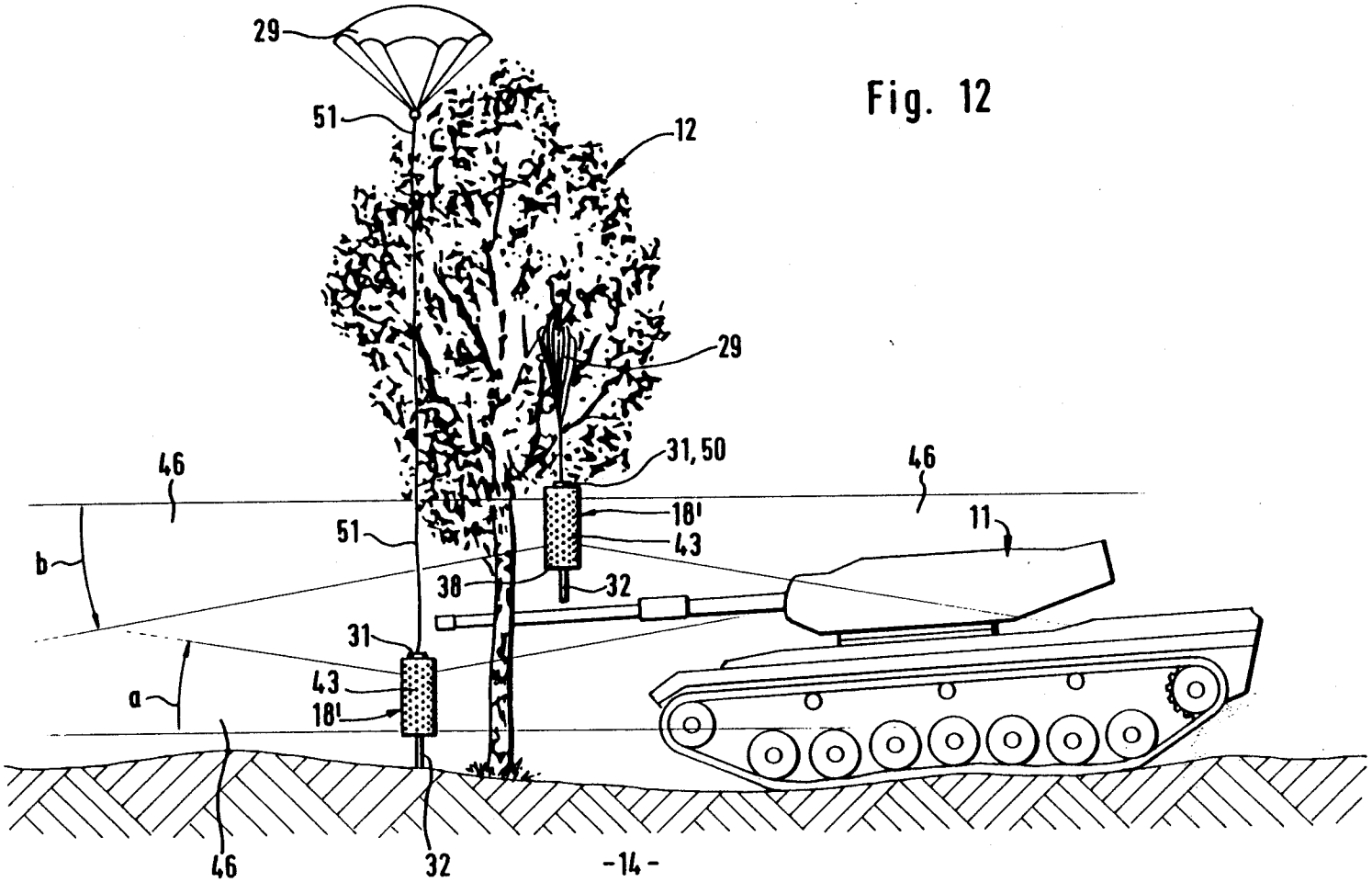
FIG. 12 illustrates the scenario for the representation for changeable directions of effectiveness for a full caliber-sized warhead pursuant to FIG. 4.

Finally, there cannot be precluded the possibility that the braking medium 29 (such as a parachute) will be caught in the protective arrangement 12 above the target object 11 (for example, in the branches of a tree) shown in FIG. 12, such that the explosive 37 (FIG. 10) will not detonate due to the lack of a hard impact by the trigger pin 32. When, subsequent to the passage of the specified time interval, the self-destruct circuit 38 comes into operation, then there is again triggered the fan of fragments 42 from deformed projectiles 45 with the encompassed incendiary compositions 44; however, the effectiveness in target objects 11 which are positioned therebelow is only slight because of the increasing dispersion of the fragment angle a (FIG. 9). In order, also in this instance, to be able to achieve an effect in the target object 11, provisions can be made of additionally equipping the explosive 37 at its trailing end with a concentric transmitting charge 36' which, as a result of the pressure build-up due to the detonation wave propagating from the oppositely located end surface, accordingly produces a fragment fan spread or cone angle b (FIG. 12) which is directed forwardly in the descending direction of flight from the horizontal, and thereby still leads to the attacking of target objects 11; however, now at angles obliquely from above. For this purpose, the oppositely oriented transmitting charge 36' is triggered by means of a time fuze 50 which, as in the case of the self-destruct circuit 38 is started by the supplying of power to the braking medium-articulation 31, but is designed for a shorter running period than the self-destruct circuit 38. The need for a separate self-destruct circuit 38 can even be eliminated, in that the transmitting charge 36' concurrently fulfills this function with the time fuze 50.

Instead thereof, or in addition thereto, the warheads 18' or respectively the submunitions 20, can also be connected through a particularly lengthy tethering cable 51 with the aerodynamic orienting and braking media 29. The cable length is hereby selected such that the typical protection 12, such as is generally formed from lightweight protective roof structures or trees will be passed through thereby; whereby the braking medium 29 still has not yet descended to the protection 12 when the trigger pin 32 already strikes against solid ground in the target area 14 and triggers the formation of the fragment angle or cone a which spreads out directed upwardly from the horizontal (as shown at the left in FIG. 12).

What is claimed is:

1. A warhead which is deliverable through the intermediary of an airborne carrier, said warhead containing aerodynamic orienting and braking means and an impact-responsive trigger pin, said trigger pin extending forwardly from said warhead in the direction of flight for the initiation of a triggering of an explosive dammed by a hollow-cylindrical wall structure of said warhead, said wall structure having shallow-concave coverings arranged about a cylindrical surface thereof, said coverings forming projectiles responsive to the triggering of said explosive, means for radially outwardly dispersing said formed projectiles at angles whose inclines increase upwardly from a horizontal from a leading covering towards a rearward covering on said cylindrical surface in the direction of flight of the projectiles; and said trigger pin possessing a response threshold which leads to the initiation of the triggering of said explosive only upon a substantially hard impact by said trigger pin against a target surface.

2. A warhead as claimed in claim 1, wherein the warhead has a single piece-integral construction including coverings oriented transversely of the longitudinal axis of said warhead, said coverings having the fragment fan angle produced through combustion of a transmitting charge commencing from an end surface of said charge which is coaxially arranged in the explosive.

3. A warhead as claimed in claim 2, including a time fuze functioning for the initiation of the transmitting charge combusting from an oppositely located end surface for the production of a forwardly oriented fragment fan angle in the direction of flight of said warhead.

4. A warhead as claimed in claim 1, wherein the coverings on the wall structure have a rear lining constituted from an incendiary composition.

5. A warhead as claimed in claim 1, wherein the submunition is suspended by a lengthy tethering cable from the aerodynamic orienting and braking means.

6. A warhead which is deliverable through the intermediary of an airborne carrier, said warhead being equipped with distribution units for axially short-constructed submunitions, each said submunition comprising aerodynamic orienting and braking means and an impact-responsive trigger pin, said trigger pin extending forwardly from said warhead in the direction of flight for the initiation of a triggering of an explosive dammed by a hollow-cylindrical wall structure of said warhead, said wall structure having shallow-concave coverings arranged about a cylindrical surface thereof, said coverings forming projectiles responsive to the triggering of said explosive, means for radially outwardly dispersing said formed projectiles at angles whose inclines increase upwardly from a horizontal from a leading covering towards a rearward covering on said cylindrical surface in the direction of flight of the projectiles; and said trigger pin possessing a response threshold which leads to the initiation of the triggering of said explosive only upon a substantially hard impact by said trigger pin against a target surface.

7. A carrier including a plurality of warheads, said warheads being arranged coaxially within said carrier, said warheads being ejectable radially from the carrier in different directions through the action of meanderingly-extending inflatable hoses, each said warhead containing aerodynamic orienting and braking means and an impact-responsive trigger pin, said trigger pin extending forwardly from said warhead in the direction of flight for the initiation of a triggering of an explosive dammed by a hollow-cylindrical wall structure of said warhead, said wall structure having shallow-concave coverings arranged about a cylindrical surface thereof, said coverings forming projectiles responsive to the triggering of said explosive, means for radially outwardly dispersing said formed projectiles at angles whose inclines increase upwardly from a horizontal from a leading covering towards a rearward covering on said cylindrical surface in the direction of flight of the projectiles; and said trigger pin possessing a response threshold which leads to the initiation of the triggering of said explosive only upon a substantially hard impact by said trigger pin against a target surface.

8. A carrier including a plurality of warheads which are inserted into plastic profiled cups in axial and parallel stacks and are retained within a casing structure of said carrier, each said warhead containing aerodynamic orienting and braking means and an impact-responsive trigger pin, said trigger pin extending forwardly from said warhead in the direction of flight for the initiation of a triggering of an explosive dammed by a hollow-cylindrical wall structure of said warhead, said wall structure having shallow-concave coverings arranged about a cylindrical surface thereof, said coverings forming projectiles responsive to the triggering of said explosive, means for radially outwardly dispersing said formed projectiles at angles whose inclines increase upwardly from a horizontal from a leading covering towards a rearward covering on said cylindrical surface in the direction of flight of the projectiles; and said trigger pin possessing a response threshold which leads to the initiation of the triggering of said explosive only upon a substantially hard impact by said trigger pin against a target surface.

* * * * *